US005081911A

United States Patent [19]

Talbot

[11] Patent Number: 5,081,911

[45] Date of Patent: Jan. 21, 1992

[54] VENT FOR SHRINK FILM PACKAGING

[75] Inventor: James E. Talbot, Wynnewood, Pa.

[73] Assignee: Protect-A-Boat of New Jersey, Inc., Springfield, Pa.

[21] Appl. No.: 473,763

[22] Filed: Feb. 2, 1990

[51] Int. Cl.[5] ..... F24F 7/00

[52] U.S. Cl. ..... 454/370; 206/335

[58] Field of Search ..... 98/1, 37; 2/DIG. 1; 206/335; 135/93

[56] References Cited

U.S. PATENT DOCUMENTS

| | | | |
|---|---|---|---|
| 3,024,717 | 3/1962 | Rozek | 98/37 |
| 4,126,973 | 11/1978 | Luckey | 98/37 X |
| 4,576,087 | 3/1986 | Wolfe | 98/1 |
| 4,763,783 | 8/1988 | Talbot | 206/335 |
| 4,898,085 | 2/1990 | Jarnot | 98/1 |

FOREIGN PATENT DOCUMENTS

| | | | |
|---|---|---|---|
| 2104770 | 3/1983 | United Kingdom | 2/DIG. 1 |

*Primary Examiner*—Harold Joyce

*Attorney, Agent, or Firm*—Panitch Schwarze Jacobs & Nadel

[57] ABSTRACT

A vent for allowing air to move between the interior and exterior of a shrink film envelope enclosing a vehicle, such as a boat, aircraft, etc., or some other object comprises a generally flat vent plate. The vent plate has oppositely facing interior and exterior surfaces and includes both a central portion and a peripheral portion. An array of holes extends through the central portion of the plate to establish fluid communication between the interior and exterior surfaces. Deflectors are positioned on the exterior plate surface for shielding the holes to inhibit entry through the holes of liquids while allowing generally unrestricted air circulation between the envelope interior and exterior. In one embodiment, the deflectors comprise an array of cowls with an individual cowl for shielding each hole of the array.

10 Claims, 2 Drawing Sheets

VENT FOR SHRINK FILM PACKAGING

FIELD OF THE INVENTION

The present invention relates to shrink film packages for equipment and more particularly to vents for such shrink film packages.

BACKGROUND OF THE INVENTION

Aircraft, particularly modern sophisticated rotary aircraft such as helicopters and collapsible wing aircraft used on ships, are highly susceptible to environmentally induced damage caused by dust, dirt, airborne particles or the like which may enter and disrupt delicate instrumentation and hydraulic systems as well as other operational systems, particularly during extended periods of non-operational storage. In addition, aircraft of this type, as well as other types of aircraft are susceptible to damage caused by wind, rain, sleet and other weather factors, as well as corrosion and other kinds of damage which may be caused by the vapors of fuels, lubricants and other vapor producing substances which are stored within the aircraft to maintain its operational readiness. These damages most frequently arise when such aircraft are subjected to prolonged shipment from one facility to another, particularly if such shipment is overseas, for example, from the United States to Europe. Such damage may be exacerbated if the aircraft is directly exposed to weather conditions such as when the aircraft is shipped on the top or upper deck of a ship.

Substantial solutions to these problems are set forth in U.S. Pat. No. 4,247,509 and 4,763,783, both by the present inventor James E. Talbot. These patents are incorporated herein by reference and the materials and methods disclosed therein are set forth in part herein in connection with the discussion of prior and related art. The two patents cited above teach materials and methods for creating a protective environment for boats and aircraft by enclosing them in a shrink film package or envelope and for managing stored-on-board fuels, lubricants and the like which may emit corrosive, flammable or explosive or otherwise hazardous fumes during the period of storage and shipment.

Talbot U.S. Pat. No. 4,763,783 further teaches that in storing or shipping a packaged aircraft it is desirable to provide for the removal of moisture which may be trapped between the shrink film envelope and the aircraft and within the aircraft itself. In addition, it is generally desirable to provide for the circulation of small amounts of air within the shrink film envelope. Therefore, some type of vent means should be installed to provide for natural air circulation which will facilitate the removal of moisture and other potentially harmful vapors which might accumulate within the shrink film envelope. Further, in cases where the packaged aircraft or other item is exposed to changes of temperature or altitude, pressure differences between the interior and exterior of the package or envelope generated by these changes, require venting means to prevent destructive stresses on the package.

The present invention teaches a vent construction which is flexible in application. In particular the vent of the present invention can be positioned on the sides, bottom or any other location of the shrink film envelope and can be quickly and easily installed either before or after the shrink film envelope is applied. Further, the vent of the present invention is simple in construction and includes positive means in the form of a scoop or cowl for preventing entry of drippage or of solid or liquid airborne particulate matter into the shrink film envelope surrounding the aircraft while allowing the free circulation of air for the removal of moisture vapor and other potentially harmful vapors.

Although the term "aircraft" is used throughout this specification for simplicity and brevity to denote the article enclosed by the shrink film package or envelope and vented by the present invention, it must be emphasized that the invention is intended to apply to a shrink film envelope as applied to any object or structure or group of objects or structures including, but not limited to, aircraft, boats and other vehicles of all sorts and sizes and component parts thereof, stationary objects and structures such as buildings, surface vehicles such as passenger automobiles and military transports and tanks, appliances such as refrigerators, computers, and components such as transformers and heat exchangers, singly, if large or in groups on pallets or in cartons or crates if small.

SUMMARY OF THE INVENTION

Briefly stated, the present invention comprises venting means for allowing air to move between the interior and exterior of a shrink film envelope enclosing an object. The venting means comprises a generally flat plate having oppositely facing interior and exterior surfaces and further having a center portion and a peripheral portion. An array of holes extends through the center portion of the plate to establish fluid communication between the interior and exterior surfaces. A deflecting means, integral with and positioned on, the exterior surface of the plate is employed for shielding the holes to inhibit entry of liquid through the holes and into the envelope interior, while allowing generally unrestricted air circulation between the envelope interior and exterior.

BRIEF DESCRIPTION OF THE DRAWINGS

The foregoing summary, as well as the following description of preferred embodiments of the invention, will be better understood when read in conjunction with the appended drawings. For the purpose of illustrating the invention, there is shown in the drawings embodiments which are presently preferred, it being understood, however, that the invention is not limited to the specific instrumentalities or the precise arrangements of elements disclosed. In the drawings.

DETAILED DESCRIPTION OF THE INVENTION

Figure 1:
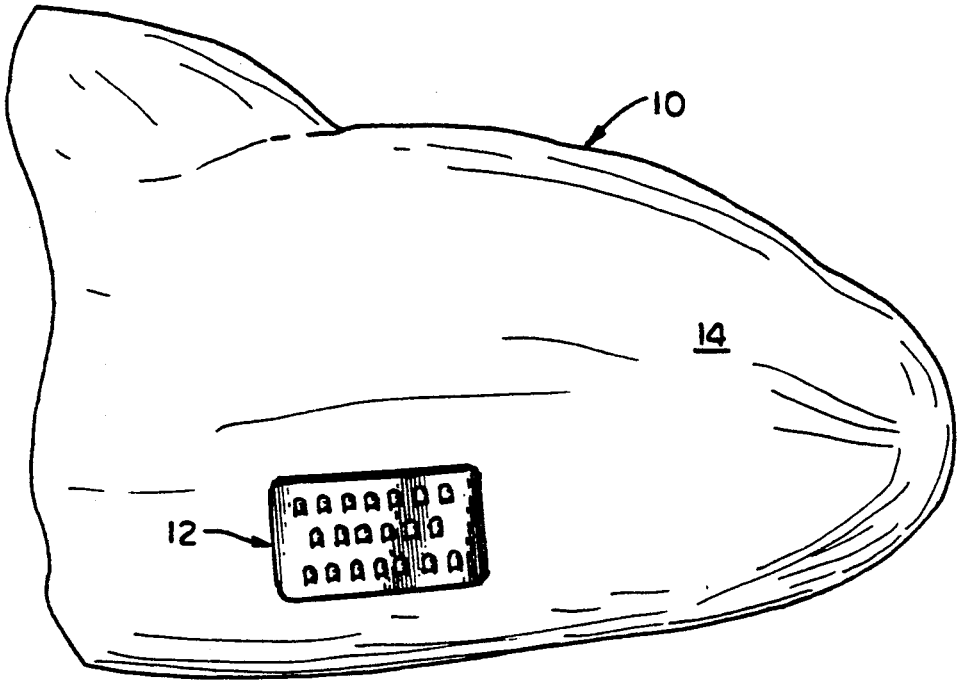
FIG. 1 is a side elevational view of a portion of an aircraft enclosed in a shrink film envelope and a vent plate in accordance with a first embodiment of the present invention.

Referring now to the drawings, wherein like references are used to indicate like elements throughout, there is shown in FIG. 1 a side elevational view of the front or forward portion of an aircraft 10 which has been packaged or enclosed in a shrink film envelope 14 generally covering the fuselage of the aircraft 10. The shrink film 14 is installed in sections (not shown) which meet at and are joined in weathertight seams to cover and protect the entire aircraft 10. The shrink film sections are fabricated from well known, generally polymeric, materials. A preferred shrink film for use in the present embodiment is made from a heavy duty grade of low density polyethylene which is adapted to shrink in both the lateral and longitudinal directions upon the application of heat. Preferably the shrink film is 0.007 inches (0.178 mm) thick and meets or exceeds Federal Specification L-P-378D, Plastic Sheet and Strip, Thin Gauge Polyolefin, Classified and Type N, Class 3, Grade B, Finish I. Thinner shrink films can be used for protecting small articles while thicker shrink films may be desirable for protecting large articles. The shrink film may include an ultraviolet inhibitor to protect the aircraft from the ultraviolet effects of the sun. For less rigorous applications, such as protection of stored pleasure boats, a natural, low density, biaxially oriented, virgin polyethylene film having thicknesses ranging from 0.003 to 0.010 inches 0.076 to 0.254 mm) may be employed. Further details concerning the method and apparatus for shrink film packaging of aircraft, portions of aircraft, boats and other objects, may be obtained from U.S. Pat. Nos. 4,763,783 and 4,247,509.

Positioned on the shrink film 14, on the side of aircraft 10, is a vent means or vent plate 12 described in greater detail hereinafter. It will be appreciated by those skilled in the art that while the vent plate 12 shown in FIG. 1 is on a lower side surface of the aircraft 10, it could be located at any other position on the aircraft and that with most aircraft multiple vent plates (not shown) may be employed.

Figure 2:
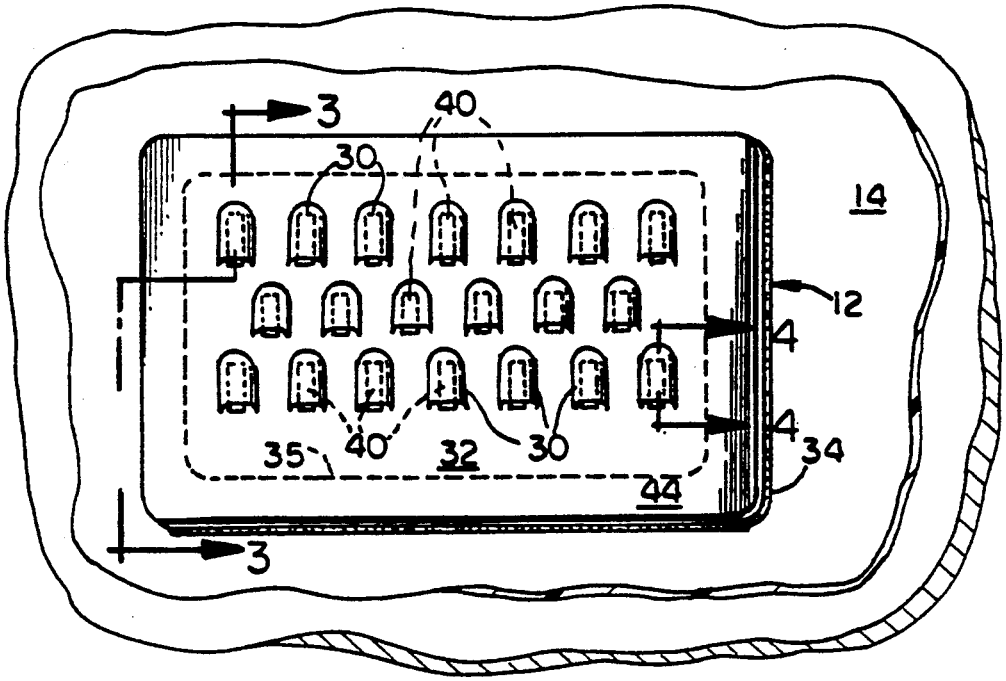
FIG. 2 is an enlarged perspective view of the vent plate of FIG. 1.

FIG. 2 shows an enlarged broken out section of a portion of the metal skin 18 of the aircraft 10 covered by the shrink film 14 on which the vent plate 12 of the present invention has been fastened. The vent plate 12, in a preferred embodiment, is a generally flat planar structure which is preferably generally rectangular in shape, as illustrated, and includes a generally central portion 32 generally surrounded by a peripheral portion 44. The surface or side of the vent plate 12 facing toward and nearest to the aircraft 10 is referred to as the interior surface of the vent plate 12, the other, opposite surface or side of the vent plate which is exposed and faces outwardly when installed on the aircraft being referred to as the exterior surface. It should be appreciated by those skilled in the art that while a generally rectangularly shaped vent plate 12 of the type shown is preferred, the vent plate 12 could be of some other shape such as square, circular, elliptical, etc. In addition, the shape of the vent plate 12 may be dictated by the particular end use. For example, the vent plate 12 may be truncated (not shown) by the removal of a portion of a lateral end so that the peripheral portion 44 extends only around three sides of the central portion 32. In addition, while the vent plate 12 of the present embodiment is generally flat with a small thickness relative to its overall length and width, it could be thicker, if desired.

An array of spaced individual openings or holes 40 is positioned in the center portion 32 of the vent plate 12, each of the holes 40 extending completely through the center portion 32 of the vent plate 12 to establish fluid communication between the interior and exterior vent plate surfaces. In the embodiment shown in FIG. 2, each of the holes 40 is generally rectangular but could be of some other shape such as circular, square, oval, etc. Each of the holes 40 is shielded by deflecting means comprising a separate scoop or cowl 30 integral with and positioned on the exterior surface of the vent plate 12.

In a preferred embodiment the vent plate 12 is molded from a thermoplastic material, such as polyethylene, polystyrene or methymethacrylate, although any comparable non-corroding material may be substituted including fiberglass, aluminum, stainless steel or titanium. One preferred form of the vent plate 12 (not shown) has an overall dimension of 4.5 ×6 inches (114 ×152 mm) and a thickness of both the central portion 32 and peripheral portion 44 of 0.042 inches (1.09 mm). The central portion 32 is generally planar and includes an array of 63 generally rectangular holes, each hole 0.125 by 0.25 inches (6.35 ×3.18 mm), the holes arranged in a staggered pattern having six rows spaced 0.5 inches (12.7 mm) apart (not shown). Although the foregoing is a substantially exact description of one preferred embodiment of the vent plate 12 of the invention, other embodiments of the vent plate could have greater or lesser overall dimensions and correspondingly greater or lesser thickness and more or fewer holes of different dimensions, shapes and spacings and cowls of different shapes which protect two or more holes without departing from the spirit of the present invention.

Figure 3:
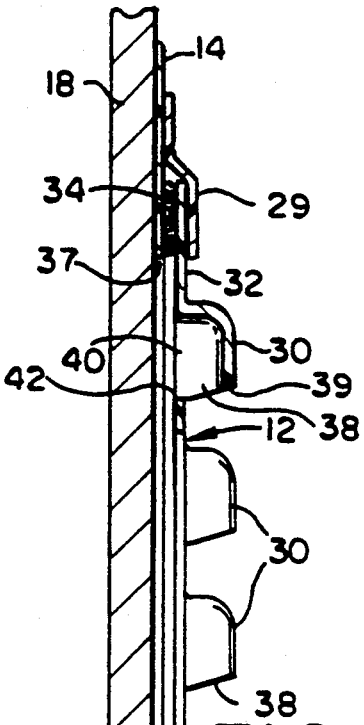
FIG. 3 is an enlarged sectional view taken along line 3—3 of FIG. 2.

As best shown in FIG. 3, an unbroken layer of adhesive 34 is coated or positioned on the interior surface of the peripheral portion 44 of the vent plate 12 for allowing convenient and efficient attachment of the vent plate 12 to the shrink film 14 after the shrink film 14 has been applied to the aircraft 10. In the preferred embodiment of the present invention, after the adhesive 34 is applied to the interior surface of the peripheral portion of the vent plate 12, a release sheet (not shown) is applied to the adhesive 34 for protecting the exposed adhesive 34 and for preserving the cleanliness and the integrity of the adhesive 34 until the time of installation. In one preferred embodiment the adhesive employed is Scotchmount White Double Coated Acrylic Foam Tape manufactured by 3M Company having the part number Y4930, though other makes and forms of adhesive can be employed.

After an installer has decided on a position on the side or bottom of the aircraft 10 where the vent plate 12 is to reside, a hole 37 (FIG. 3) the approximate size and shape of the center portion 32 of the vent plate 12 is cut into the shrink film 14 at the selected position. The release sheet is peeled or removed from the exposed surface of the adhesive 34 and the vent plate 12 is pressed into position on the film 14 such that the adhesive 34 completely surrounds the hole 37 and engages the surrounding portion of the shrink film 14. Preferably, the vent plate 12 is installed in the orientation shown in FIGS. 2 and 3 with the openings in the cowls 40 facing downwardly to prevent moisture running down the side of the shrink film envelope from entering the holes 40 while permitting air flow through the holes. An elongated strip of heat shrinkable tape or shrink film 29 may be applied around the exterior facing peripheral portion 44 of the vent plate 12 after the vent plate has been applied to the shrink film 14 in order to prevent moisture from flowing behind the vent plate 12 and to further secure the vent plate 12 to the shrink film 14 against accidental removal during storage or shipment.

In the embodiment of the present invention illustrated in FIGS. 2 and 3 the vent plate 12 is positioned on and fastened to a section of shrink film 14 overlying and in close contact with a section of metal skin 18 of the aircraft 10. In an alternate embodiment of the present invention (not shown), the vent plate 12 may be positioned on a section of shrink film 14 which is over a vent or other openings in the aircraft skin or which is not in direct contact with the aircraft 10 but is spaced from the metal skin 18 by an opening or other discontinuity in the surface of the aircraft 10 or by a layer of protective foam (not shown) positioned between shrink film 14 and the metal skin 18 of the aircraft 10. If desired, the vent plate 12 may be installed on the underside of the aircraft 10 or at a low point to facilitate drainage of any moisture which may be trapped within the shrink film envelope.

Figure 4:
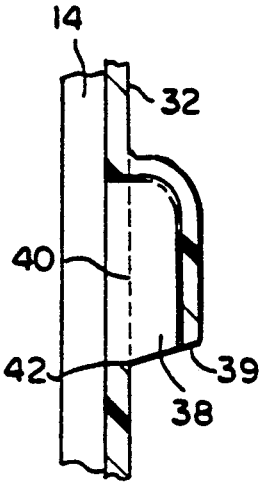
FIG. 4 is a greatly enlarged sectional view taken along line 4—4 of FIG. 2.

As best shown in FIG. 3, the cowls 30 are positioned on the exterior surface of the vent plate 12, each partially covering one of the holes 40 but having openings 38 on one end (the lower end) providing fluid communication between the interior and exterior surfaces of the vent plate 12. This construction is shown more clearly in FIG. 4. which is a greatly enlarged side elevation in cross section of one of the cowls 30 of FIG. 2 taken along lines 4—4. In FIG. 4 hole 40 generally traverses the entire height of the cowl 30 with the lower lip 42 of the hole 40 extending slightly below the lower lip 39 of the cowl 30 to permit air circulation while blocking the direct flow of moisture through hole 40.

Figure 5:
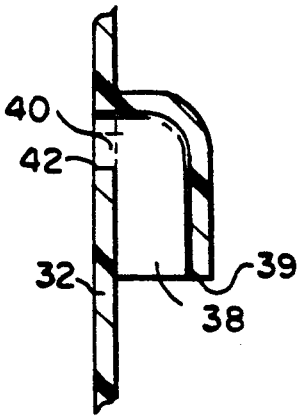
FIG. 5 is an enlarged sectional view of a second embodiment of the present invention showing a smaller vent hole relative to its protective cowl.

FIG. 5 illustrates another embodiment of the cowl 30 of the present invention in which the hole 40 is substantially smaller than the overall length of the cowl 30 so that the lower lip 42 of the hole 40 is higher than the lower lip 39 of cowl 30, thereby better ensuring against entry of drippage from rain or condensation of humidity into the shrink film envelope 16.

Figure 6:
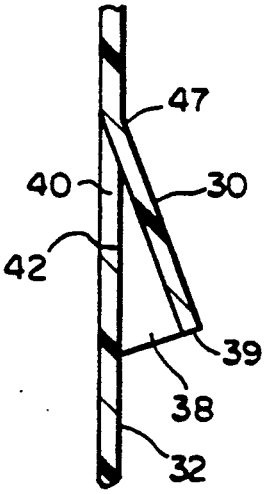
FIG. 6 is an enlarged sectional view of a third embodiment of the present invention showing a vent hole with another form of protective cowl.

Referring now to FIG. 6, there is illustrated another embodiment of the cowl 30 of the present invention in which the cowl 30 is formed of a section of a cone cut through its central axis. The hole 40 is positioned near the apex 47 of the conical cowl 30 for effective protection against drippage entering the shrink film envelope.

Figure 7:
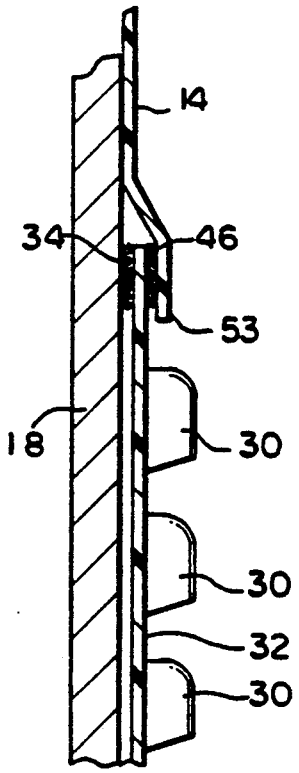
FIG. 7 is an enlarged sectional view of a fourth embodiment of the present invention having adhesive on both primary surfaces of the peripheral portion of the vent plate.

FIG. 7 illustrates another embodiment of the present invention in which the vent plate 12 has adhesive 34 and 36 positioned on both the interior and exterior surfaces of its peripheral portion 44. Adhesive 34 is positioned on the interior surface of the vent plate 12 and in that position allows the vent plate 12 to be fastened directly to the metal skin 18 of the aircraft 10 before the shrink film 14 is applied. After the shrink film is applied it covers the vent plate 12 completely. The installer then cuts the shrink film 14 along the edge 53 which forms a visible boundary between the central portion 32 and the peripheral portion 44 of vent plate 12 thereby removing a piece of the shrink film the approximate size of the central portion 32. In this embodiment, the process of cutting the hole 37 in the shrink film 14 does not generate any risk of scoring or otherwise damaging the metal skin 18 of aircraft 10 since the cutting is carried out against the vent plate 12. Further, the elongated reinforcing and retaining strip 29 of FIG. 3 can be omitted in this embodiment because the vent plate 12 is doubly secured, first by the adhesive 34 directly to the metal skin 18 of the aircraft 10, and second by the shrink film 14 which overlays the peripheral portion of the vent plate 12 and is secured to it by the adhesive 46 on the exterior side of the peripheral portion of the vent plate 12. If desired, the vent plate 12 shown in FIG. 7 could be installed in the manner shown in FIG. 3 with the exterior surface adhesive 46 serving to engage and secure the overlapping restraining strap 29 to the exterior surface of the vent plate 12.

From the foregoing description, it can be seen that the present invention comprises an advanced vent assembly for a shrink film or other protective envelope. It will be appreciated by those skilled in the art that changes could be made to the above-described embodiments without departing from the broad inventive concepts thereof. It is understood, therefore, that this invention is not limited to the particular embodiments disclosed, but is intended to cover all modifications which are within the scope and spirit of the invention as defined by the appended claims.

I claim:

1. Venting means for allowing air to move between the interior and exterior of a shrink film envelope enclosing an object, said venting means comprising:

a generally flat plate having oppositely facing interior and exterior surfaces and further having a center portion and a peripheral portion;

an array of holes extending through the center portion of the plate whereby fluid communicationa is established between the interior and exterior plate surfaces;

an array of cowls integral with and positioned on the exterior surface of the plate, each of said cowls formed of an inflexible material, each cowl for shielding one of the holes, said holes and cowls being sized, shaped, and oriented to inhibit entry of fluids through the holes and into the evelope interior while allowing generally unrestricted air circulation between the envelope interior and exterior; and an adhesive located on the peripheral portion of the plate, whereby the plate can be fastened to the envelope.

2. Venting means as recited in calim 1 wherein each cowl comprises a segment of a tubular cylinder having a closed end portion and an open end portion.

3. Venting means as recited in claim 1 wherein each cowl is in the form of a segment of a cone sectioned through its axis.

4. Venting means as recited in claim 1 where in the adhesive is on the interior surface of the plate.

5. Venting means as recited in claim 1 wherein the adhesive is on both the exterior and the interior surfaces of the plate.

6. An object having a shape, an envelope formed on a film-like material enclosing and generally conforming to the shape of the object, the envelope defining an interior and an exterior, and venting means secured to the film-like material for allowing air to move between the envelope interior and exterior, said venting means comprising:

a generally flat plate having oppositely facing interior and exterior surfaces and having a center portion and a peripheral portion, said plate having an adhesive located on the peripheral portion of the plate such that the plate can be fastened to the envelope;

an array of holes extending through the center portion of the plate whereby fluid communication is established between the interior and exterior plate surfaces; and an array cowls integral with and positioned on the exterior surface of the plate, each of the cowls formed of an inflexible material, each cowl for shielding one of the holes, said holes and cowls being sized, shaped and oriented to inhibit entry of liquids through the holes and into the envelope interior while allowing generally unrestricted air circulation between the envelope interior and exterior.

7. Venting means as recited in claim 6 wherein each cowl comprises a segment of a tubular cylinder having a closed end portion and an open end portion.

8. Venting means as recited in claim 6 wherein each cowl is in the form of a segment of a cone sectioned through its axis.

9. Venting means as recited in claim 8 wherein the adhesive is on the interior surface of the plate.

10. Venting means as recited in claim 8 wherein the adhesive is on both the exterior and the interior surfaces of the plate.

* * * * *